US005506379A

United States Patent [19]

McLean, Jr. et al.

[11] Patent Number: 5,506,379

[45] Date of Patent: Apr. 9, 1996

[54] DIRECT CONNECT YOKE TERMINAL

[75] Inventors: David H. McLean, Jr., Plymouth; Roberto A. Tomassi, Livonia, both of Mich.

[73] Assignee: United Technologies Automotive, Inc., Dearborn, Mich.

[21] Appl. No.: 342,826

[22] Filed: Nov. 21, 1994

[51] Int. Cl.[6] ..... H01H 21/82

[52] U.S. Cl. ..... 200/558; 200/557

[58] Field of Search ..... 200/558, 553, 200/557, 559, 563, 275, 238, 239, 284; 29/622

[56] References Cited

U.S. PATENT DOCUMENTS 2,828,393 3/1958 Wingard ..... 200/284

2,972,663 2/1961 Zanichkowsky ..... 200/558

3,225,156 12/1965 Sahrbacker ..... 200/557

5,293,507 3/1994 Hayakawa ..... 200/553

*Primary Examiner*—David J. Walczak

*Attorney, Agent, or Firm*—Donald R. Fraser

[57] ABSTRACT

A switching assembly is disclosed which includes a base structure, spaced apart electrical contacts secured thereto, an electrical contact strip for selective electrical contact with the contacts, and spring biased switching means normally forcing the contact strip into selective engagement with one of the electrical contacts, the improvement resides in an electrical yoke terminal having one portion supporting the contact strip intermediate the ends thereof and another integral portion extending through the base structure for securing the yoke terminal to the base structure.

4 Claims, 2 Drawing Sheets

DIRECT CONNECT YOKE TERMINAL

BACKGROUND OF THE INVENTION

The present invention relates to electrical switching mechanism and more particularly to an electrical switch design suitably useful in vehicle seat control.

DESCRIPTION OF THE PRIOR ART

In current vehicles, the seat structures are adapted to be electrically controlled to perform a number of operations. The seat structures are designed to be moved through a series of movements by the selective energization of drive motors. The drive motors are activated through manually actuated switches. Typically, these switches may be mounted in the interior door panels. Due to limited space available for such switching assemblies, the assemblies are designed to consume as little space as possible. Such miniaturization has had a modicum of success.

The miniaturization of the switching mechanism has resulted in problems dealing with intermittent electrical contact, loosening of parts after repeated duty cycles, and complicated the assembly procedures.

SUMMARY OF THE INVENTION

It is an object of the invention to produce an electrical switching mechanism which can be designed to consume minimal space.

Another object of the invention is to produce an electrical switching mechanism which is simple in structure and incorporates inherent electrical conductivity.

Another object of the invention is to produce a switching mechanism particularly suitable for automotive use which comprises a minimal number of parts and may be readily manufactured and assembled.

Still another object of the invention is to produce a switching mechanism which can be exposed to considerable mechanical shock and vibrational forces without any degradating effects.

The above and other objects of the invention may typically be achieved by an electrical switching assembly including a base structure, spaced apart electrical contacts secured thereto, an electrical contact strip for selective electrical contact with the contacts, and spring biased switching means normally forcing the contact strip into selective contact with one of the electrical contacts, the improvement comprising an electrical yoke terminal having one portion supporting the contact strip intermediate the ends thereof and another integral portion extending through the base structure; means affixing the yoke terminal to the base structure; and electrical conduit means coupling the yoke terminal to a source of electrical power.

Further objects and advantages of this invention will be apparent from the following description and appended claims, reference being made to the accompanying drawings forming a part of the specification, wherein like reference characters designate corresponding parts in the several views.

BRIEF DESCRIPTION OF THE DRAWINGS

The above, as well as other, objects and advantages of the invention will become manifest to those skilled in the art from reading the following detailed description of a preferred embodiment of the invention when considered in the light of the attached drawings, in which.

DETAILED DESCRIPTION OF THE PREFERRED EMBODIMENTS

Figure 1:
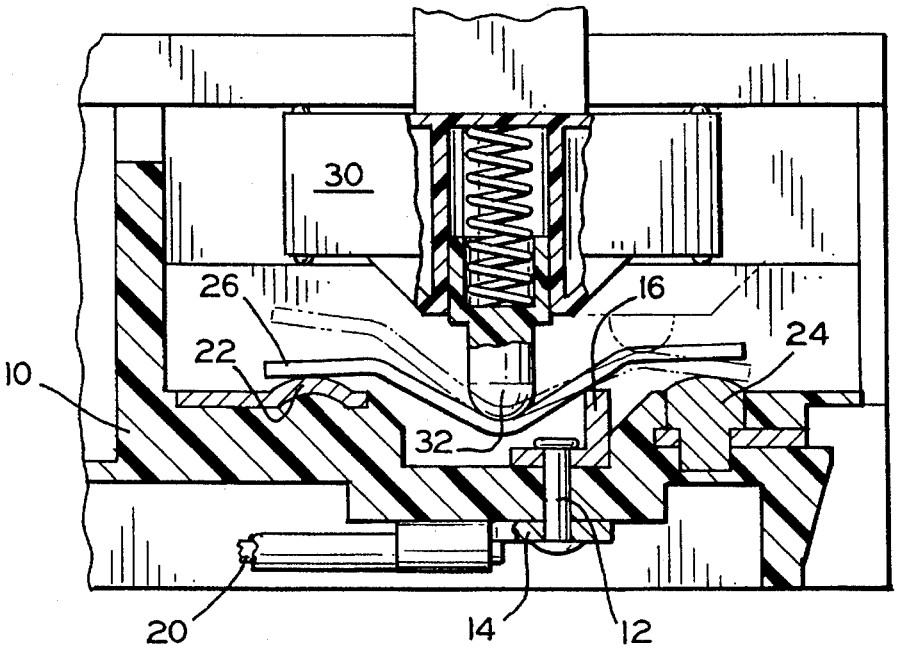
FIG. 1 (PRIOR ART)
FIG. 1 is a fragmentary sectional view of a switching assembly in accordance with the prior art.

Referring to FIG. 1, there is illustrated a switching assembly illustrative of the prior art over which the present is an improvement. The switching assembly includes a base structure to formed of a moldable plastic material, for example. The structure 10 is designed to be typically mounted in the front door panels of an automobile forward of the armrest and is secured in place by suitable fastening means, such as threaded fasteners, for example.

The switching assembly is employed to energize an associated drive motor to cause the driver's seat, for example to raise, lower, tilt, advance, or retract, and in certain instances to actuate a lumbar support mechanism. The assembly illustrated in FIG. 1 employs a rivet 12 to secure two portions of an electrical terminal comprised of an eyelet 14 and a yoke member 16. Electrical current is typically supplied to the terminal through a wire 20 which is crimped to the eyelet 14.

Associated with the yoke terminal 16, there is a ground buss bar terminal 22 and a B+ feed contactor 24. A generally V-shaped contactor strip 26 is positioned within slots formed in the base 10. The bottom surface of the contactor 26 is adapted to be in electrical contact with and continuously rest upon the upper edge of the yoke terminal 16.

A sliding switch mechanism 30 having a downwardly extending spring biased plunger 32 is disposed to slide to and fro within the base 10. The spring biased plunger 32 is designed to constantly urge against the upper surface of the contactor 26. Normally the spring biased plunger 32 is in the position shown as full line in FIG. 1. In the normal position, the one end of the contactor 32 is in electrical contact with the ground buss bar terminal 22. However, when the sliding switch mechanism 30 is moved causing the spring biased plunger 32 to move to position illustrated in phantom, the plunger 32 functions to, in effect, rock the contactor 26 causing the one end to move out of contact with the buss bar terminal 22 and forces the opposite end into contact with the B+ feed contactor 24. When such electrical contact is completed, an associated drive motor is energized thereby to perform or accomplish one of the above mentioned seat functions. Upon completion of the function, the operator ceases to apply force to the sliding switch. The plunger 32 then causes the switch to return to the normal position illustrated in full line in FIG. 1. More specifically, it must be appreciated that when the switch mechanism is forced from the normal at rest position, the plunger 32 is cammed upwardly against the bias of the associated spring. However, upon cessation of the sliding force causing contact of the contactor 26 with the B+ feed contactor 24, the energy in the compressed spring causes the plunger 32 to be forced downwardly and is caused to slide toward the apex of the V-shaped contactor 26 and repositions the contactor to the full line position of FIG. 1.

Now with reference to the improved structure illustrated in FIGS. 2 through 6 inclusive, there is shown a switching assembly embodying the features of the present invention. More specifically, and with initial attention to the structure illustrated in FIG. 2, there is shown a switching assembly incorporating certain of the same elements as utilized in the assembly illustrated in FIG. 1 are used in the structure of FIG. 2. Such similar elements are identified by primed reference numerals.

Figure 2:
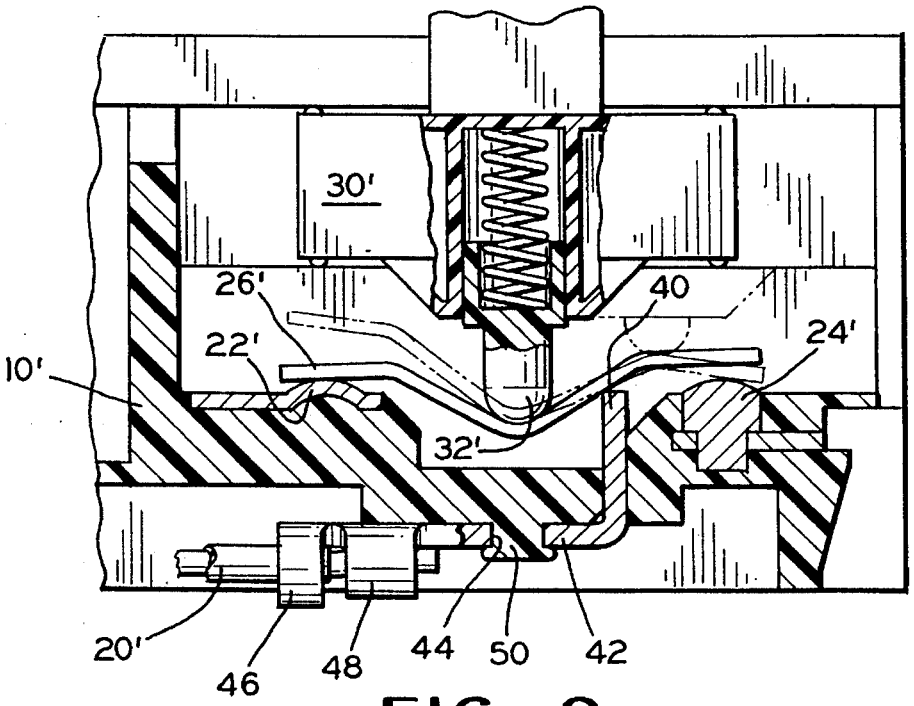
FIG. 2 is a fragmentary sectional view of a switching assembly similar to that illustrated in FIG. 1 which embodies the features of the invention.
Figure 3:
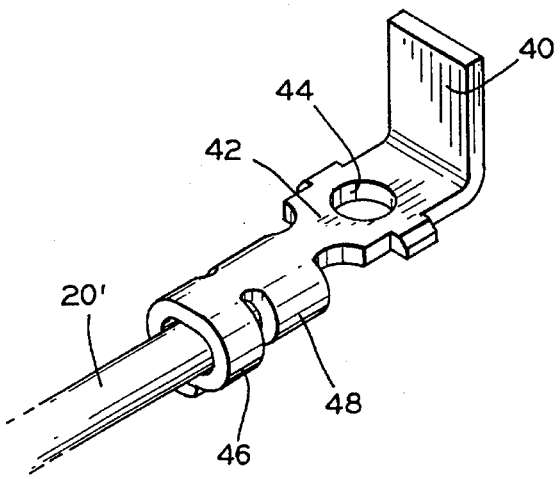
FIG. 3 is a perspective view of the yoke terminal illustrated in FIG. 2.
Figure 4:
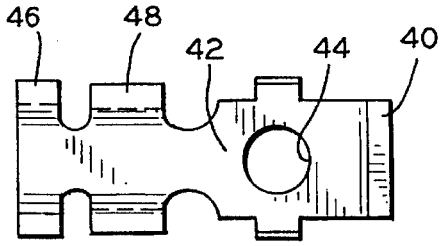
FIG. 4 is a top plan view of the yoke terminal illustrated in FIG. 3.
Figure 5:
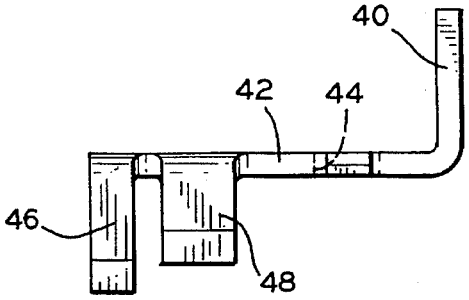
FIG. 5 is a side elevational view of the yoke terminal illustrated in FIGS. 3 and 4.

The switching assembly of FIG. 2 includes a base 10' typically mounted in the front door panel of an automobile and is secured in place by suitable fastening means. The assembly includes an improved one-piece yoke member 40 shown in particular detail in FIGS. 3 through 6. The yoke member 40 includes a central body portion 42 containing an aperture 44 and a pair of crimping arms 46 and 48 for securing the yoke terminal to an associated energizing wire 20'.

The terminal yoke 40 is assembled by initially crimping the arms 46 and 48 about the insulated sheath and the bare wire, respectively, of the energizing wire 20'

The terminal yoke 40 is then inserted into and through a suitable opening in the associated base structure 10' and the assembly is heat staked to the base structure by introducing heat energy to a defined zone in the region defined by the aperture 44 causing the plastic material of the base structure 10' to flow to form a staked joint 50. The yoke terminal 40 is thus snugly affixed to the base structure 10' and provides a one-piece electrical conduit within the supporting base structure.

The operation of the embodiment illustrated in FIGS. 2 through 6, inclusive, is the same as that described in the description of the structure illustrated in FIG. 1. However, it will be clearly apparent that the resultant electrical and mechanical connections are substantially improved and result in an extended life cycle as well as facilitate the assembly operation.

In operation, when the switch mechanism is forced from the normal at rest position, the plunger 32' is cammed upwardly against the bias of the associated spring. As the switch mechanism is moved forwardly, the plunger 32' causes the contactor 26' to be rocked over a fulcrum provided by the uppermost edge of the yoke terminal 40 effectively lifting the one end of the contactor 26' out of contact with the buss bar terminal 22' and simultaneously forcing the opposite end into contact with the B+ feed contactor 24' In such latter position, electrical energy is fed to an associated electric motor to perform some desired function.

Upon cessation of the sliding force, the energy in the compressed spring causes the plunger 32' to be forced downwardly causing the plunger 32' and the associated switching mechanism to slide toward the apex of the V-shaped contactor 26' and reposition the contactor 26' to the full line position illustrated in FIG. 2.

Figure 7:
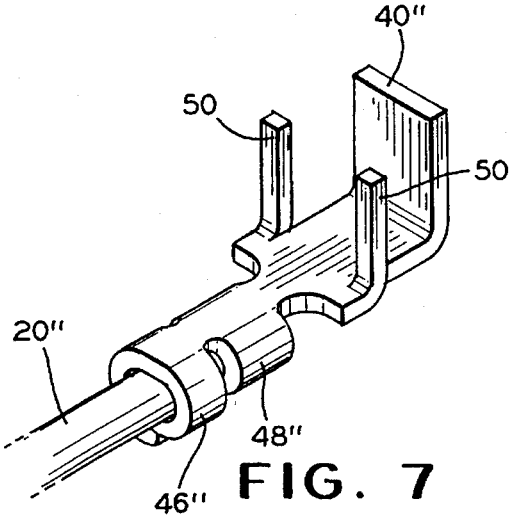
FIG. 7 is a perspective view of an alternative yoke terminal capable of being staked to an associated switch assembly base.
Figure 6:
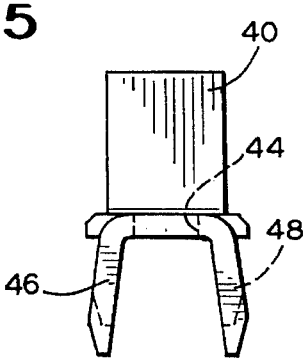
FIG. 6 is a front elevational view of the yoke terminal illustrated in FIGS. 3, 4, and 5.
Figure 8:
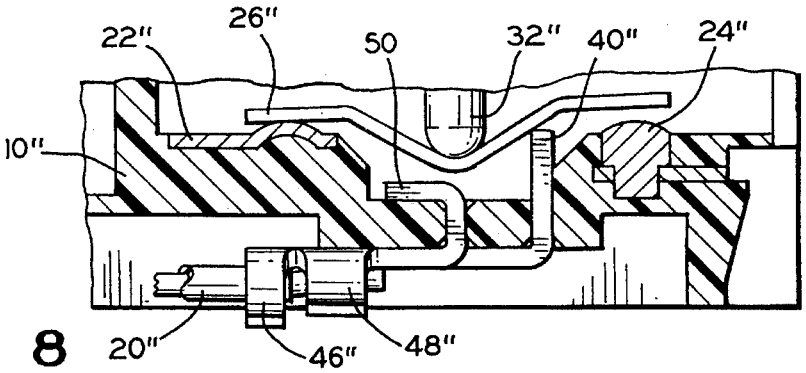
FIG. 8 is a fragmentary sectional view similar in part to FIGS. 1 and 2 showing the yoke terminal illustrated in FIG. 7.

FIGS. 7 and 8 illustrate an embodiment of the invention illustrated in FIGS. 2 through 6 and, more specifically, disclose an alternative structure for effecting a mechanical connection between a base structure 10" and the yoke terminal assembly. Double prime reference numerals are used to depict structural elements which are the same as corresponding parts illustrated in FIGS. 1 through 6.

More specifically, the illustrated embodiment is directed to a switching mechanism wherein spaced apart staking arms 50 are formed integral with the yoke terminal 40" During assembly, it will be appreciated that suitably aligned apertures are formed in the base structure 10" to receive the yoke terminal 40" and the staking arms 50, respectively. Once the yoke terminal assembly is offered up to the base structure 10", the staking arms 50 are bent upon themselves as illustrated in FIG. 8 to mechanically affix the yoke terminal assembly to the base structure 10".

It will be appreciated that the operation of the embodiment of FIGS. 7 and 8 is the same as that earlier described in respect of the embodiment illustrated in FIGS. 2 through 6. Accordingly, no further description thereof is deemed necessary.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. In an electrical switching assembly including a base structure having an upper surface, spaced apart electrical contacts secured to said upper surface, an electrical contact strip for selective electrical contact with the contacts, and spring biased switching means normally forcing the contact strip into selective contact with one of the electrical contacts, the improvement comprising:

a one-piece electrically conductive yoke member having spaced apart end portions and a central portion interconnecting the end portions, the central portion extending along a lower surface of the base structure which is disposed opposite said upper surface, one end portion of the central portion terminating at the lower surface of the base structure, and the opposite end portion formed to extend through the upper surface for supporting said contact strip;

means positioned on the lower surface for affixing said central portion of said yoke member to the lower surface of the base structure; and electrical conduit means for coupling the one end portion of said yoke member to a source of electrical power.

2. The switching assembly defined in claim 1 wherein the central portion of said yoke member is provided with a heat staking aperture.

3. The switching assembly defined in claim 2 wherein said yoke member is heat staked to the base structure via said heat staking aperture.

4. The switching assembly defined in claim 1 wherein said yoke member is mechanically staked to the base structure.

* * * * *

UNITED STATES PATENT AND TRADEMARK OFFICE

CERTIFICATE OF CORRECTION

PATENT NO. : 5,506,379

DATED : Apr. 9, 1996

INVENTOR(S) : McLean, Jr. et al.

It is certified that error appears in the above-indentified patent and that said Letters Patent is hereby corrected as shown below:

In Column 2, line 31: "structure to" should be --structure 10--.

Signed and Sealed this

Fifteenth Day of April, 1997

Bruce Lehman

*Attest:*

BRUCE LEHMAN

*Attesting Officer*

*Commissioner of Patents and Trademarks*